US005664341A

United States Patent [19]

Schmidt et al.

[11] Patent Number: 5,664,341

[45] Date of Patent: Sep. 9, 1997

[54] SOLE AND HEEL STRUCTURE WITH PREMOLDED BULGES AND EXPANSIBLE CAVITIES

[75] Inventors: Karl M. Schmidt, Woodside; Stuart E. Jenkins, Thousand Oaks, both of Calif.; Harry W. Edwards, Barrington, Ill.

[73] Assignee: Energaire Corporation, Pebble Beach, Calif.

[21] Appl. No.: 581,947

[22] Filed: Jan. 2, 1996

[51] Int. Cl.[6] ..... A43B 13/18; A43B 13/20

[52] U.S. Cl. ..... 36/28; 36/29; 36/35 B

[58] Field of Search ..... 36/28, 29, 35 B, 36/35 R, 3 R, 3 B, 71

[56] References Cited

U.S. PATENT DOCUMENTS

| | | | |
|---|---|---|---|
| Re. 34,102 | 10/1992 | Cole et al. | 36/28 |
| 896,075 | 8/1908 | Badgley | 36/29 |
| 4,361,969 | 12/1982 | Vermonet | 36/29 |
| 4,499,672 | 2/1985 | Kim | 36/29 |
| 4,577,417 | 3/1986 | Cole | 36/29 |
| 4,670,995 | 6/1987 | Huang | 36/29 |
| 5,097,607 | 3/1992 | Fredericksen | 36/28 |
| 5,131,174 | 7/1992 | Drew et al. | 36/29 |
| 5,220,737 | 6/1993 | Edington | 36/28 |
| 5,224,277 | 7/1993 | Sang Do | 36/28 |
| 5,283,963 | 2/1994 | Lerner et al. | 36/28 |
| 5,353,459 | 10/1994 | Potter et al. | 36/29 |
| 5,375,346 | 12/1994 | Cole et al. | 36/29 |
| 5,392,534 | 2/1995 | Grim | 36/88 |
| 5,406,719 | 4/1995 | Potter | 36/28 |
| 5,545,463 | 8/1996 | Schmidt et al. | 36/29 |

FOREIGN PATENT DOCUMENTS

| | | | |
|---|---|---|---|
| 2073006 | 10/1981 | United Kingdom | 36/29 |
| 8910074 | 11/1989 | WIPO | 36/29 |
| 9110376 | 7/1991 | WIPO | 36/28 |

*Primary Examiner*—M. D. Patterson
*Attorney, Agent, or Firm*—Emrich & Dithmar

[57] ABSTRACT

A shoe sole and heel construction is provided. The construction includes a structure having an exterior ground-contacting surface, a flexible bulge formed in the structure and projecting from the exterior ground-contacting surface for contact with the ground in use and defining a first pocket. The construction also includes a second resiliently expansible pocket formed in the structure and disposed to avoid contact with the ground in use and a passageway formed in the structure and communicating with each of the first and second pockets. Fluid is permanently confined in a space jointly defined by the pockets and the passageway whereby when an external force is applied to the bulge, fluid is forced from the first pocket through the passageway to expand the second pocket and when the external force is removed, the expanded second pocket resiliently forces fluid back to the first pocket.

20 Claims, 7 Drawing Sheets

SOLE AND HEEL STRUCTURE WITH PREMOLDED BULGES AND EXPANSIBLE CAVITIES

BACKGROUND OF THE INVENTION

1. Field of the Invention

The present invention relates to shoe sole and heel constructions and, in particular, to such constructions with fluid-filled cavities for providing cushioning.

2. Description of the Prior Art

Various types of shoe sole and heel constructions having fluid-containing cavities have heretofore been provided, such constructions being disclosed, for example, in U.S. Pat. Nos. 4,237,625, 4,358,902, 4,577,417, 5,375,346 and 5,416,986.

These patents disclose a molded outer sole and heel structure which has downwardly projecting heel and metatarsal bulges molded therein to define cavities and a passageway extending between the cavities. Air or other fluid, at atmospheric (or other) pressure, moves back and forth between the cavities through the passageway during movement of a person wearing the shoe.

These prior sole and heel structures have provided cushioning for the user's foot and have also provided forward thrust which facilitates walking or running movements. These bulges usually, however, prevent the member from having an exterior flat portion in the heel and sole portion of the outsole which limits the versatility of the shoe. Additionally, these bulges tend to produce a lateral instability in the shoe, causing the shoe to tilt laterally inwardly or outwardly in use, resulting in pronation or supination of the wearer's feet.

Additionally, the passageways connecting the bulges are usually large and must be properly sized to prevent large quantities of air from residing therein, where it provides no cushioning.

SUMMARY OF THE INVENTION

It is a general object of the invention to provide an improved shoe sole and heel construction which avoids the disadvantages of prior structures while affording additional structural and operational advantages.

An important feature is the provision of a shoe sole and heel construction which is of relatively simple and economical construction.

A still further feature of the invention of a shoe sole and heel construction which can have a substantially flat exterior portion which provides improved lateral stability.

Yet another important feature of the invention is the provision of a shoe sole and heel construction of the type set forth which includes fluid-filled cavities and communicating passageways therebetween, which optimize the cushioning effect of the fluid.

These and other features of the invention are attained by providing a shoe sole and heel construction including a structure having an exterior ground-contacting surface, a flexible bulge formed in the structure and projecting from the exterior ground-contacting surface for contact with the ground in use and defining a first pocket. The construction also includes a second resiliently expansible pocket formed in the structure and disposed to avoid contact with the ground in use and a passageway formed in the structure and communicating with each of the first and second pockets. Fluid is permanently confined in a space jointly defined by the pockets and the passageway whereby when an external force is applied to the bulge, fluid is forced from the first pocket through the passageway to expand the second pocket and when the external force is removed, the expanded second pocket resiliently forces fluid back to the first pocket.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 1:
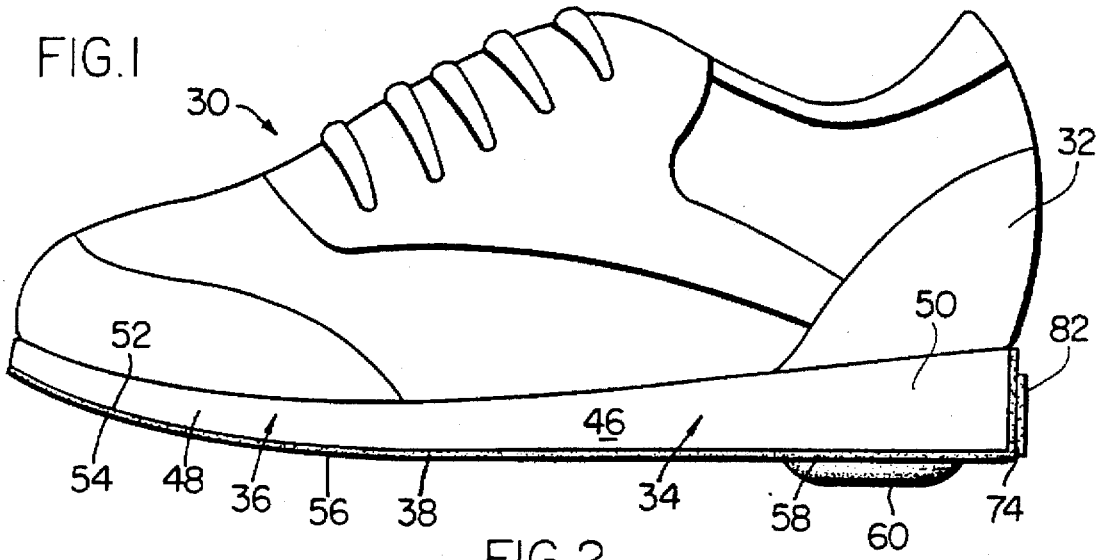
FIG. 1 is a side elevational view of a shoe incorporating a sole and heel structure in accordance with an embodiment of the present invention.
Figure 2:
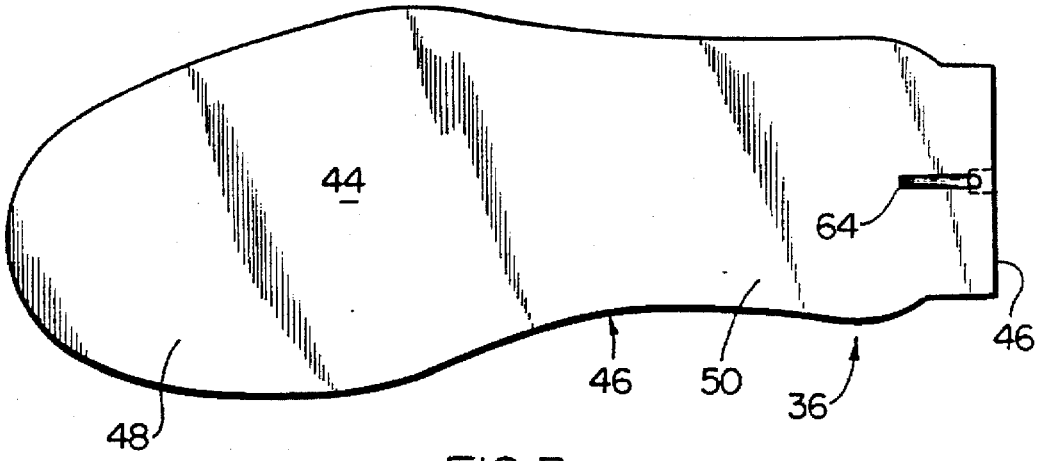
FIG. 2 is a bottom plan view of a midsole of the shoe of FIG. 1.
Figure 3:
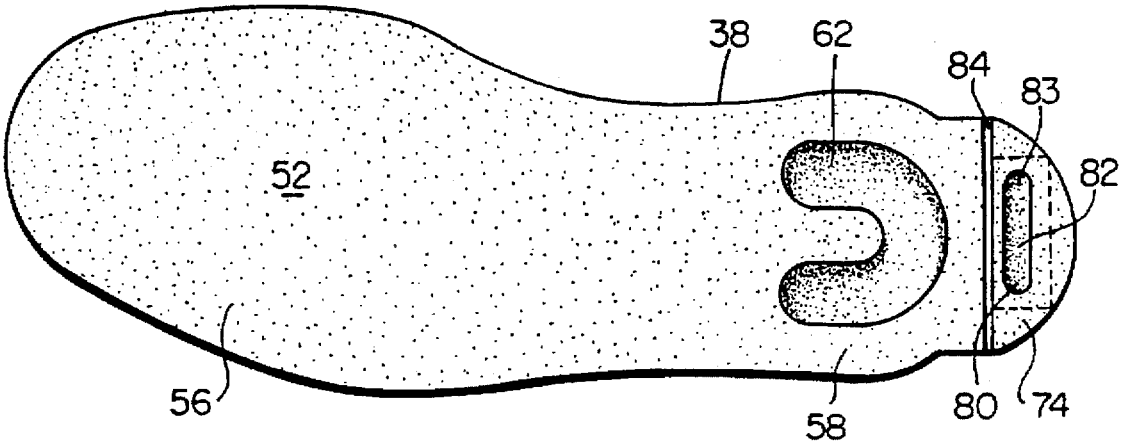
FIG. 3 is a top plan view of the outsole of the shoe of FIG. 1.
Figure 4:
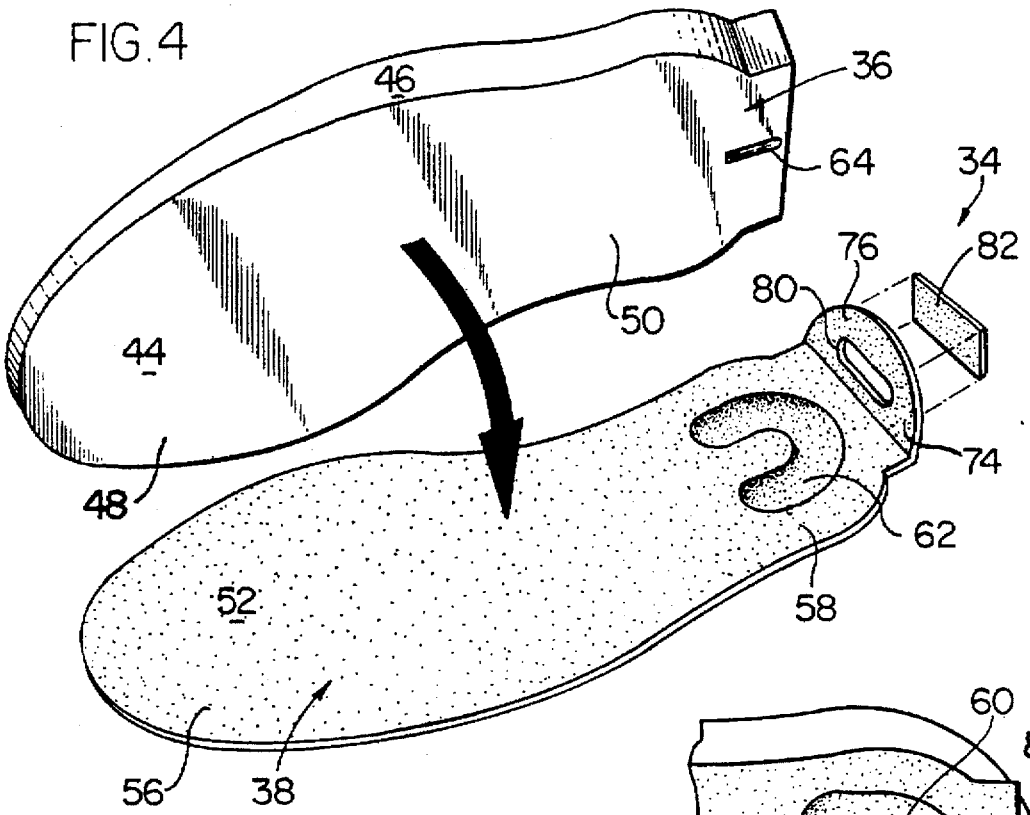
FIG. 4 is an exploded, perspective view of the outer sole and heel structure of the shoe of FIG. 1.
Figure 5:
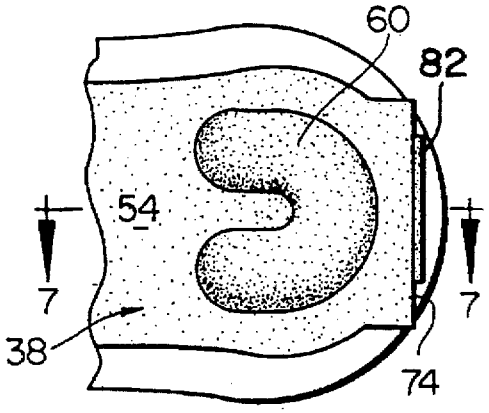
FIG. 5 is an enlarged, fragmentary, bottom plan view of the shoe of FIG. 1.
Figure 6:
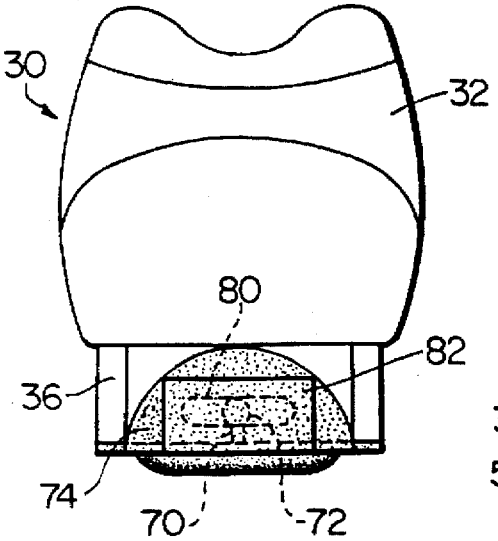
FIG. 6 is a rear elevational view of the shoe of FIG. 1.

As seen in FIGS. 1–7, a shoe 30 having a conventional upper or last 32 is provided. The shoe 30 also includes an outer sole and heel structure 34. The structure 34 includes a midsole 36 overlying an outsole 38. The midsole 36 has an upwardly facing surface 40 which faces a sock-liner 42 (FIG. 7) and a downwardly facing surface 44 which faces the outsole 38. The midsole 36 also, as seen in FIGS. 2 and 4, has a peripheral side surface 46 disposed between the upwardly facing surface 40 and the downwardly facing surface 44. As discussed in greater detail below, the midsole 36 may be a molded piece made out of a generally light-weight, non-porous material, such as polyurethane or EVA. The midsole 36, as seen in FIGS. 1, 2 and 4, has a sole portion 48 located under the sole of a wearer's foot and a heel portion 50 located under the heel of a wearer's foot.

The outsole 38 is an elongated, thin member of one-piece molded construction, preferably made of a highly flexible, wear-resistant material, such as rubber. A very useful rubber is a rubber sole under the brand name INDY 500 and made by the Goodyear Tire & Rubber Company.

As seen in FIGS. 1, 3–5 and 7, the outsole 38 has an interior surface 52 which faces the midsole 36 and an exterior surface 54 (opposite interior surface 52) which is subject to engagement with the pavement or underlying support surface, which will hereinafter be referred to as the "ground". The outsole 38 also has a sole portion 56 located under the sole portion 48 of the midsole 36 and the sole of a wearer's foot and a heel portion 58 located under the heel portion 50 of the midsole 36 and the heel of a wearer's foot.

A flexible, generally U-shaped heel bulge 60 is molded into the heel portion 58 of the outsole 38 and projects downwardly from the exterior surface 54. The heel bulge 60 underlies the heel area of a wearer's foot for which the sole and heel structure 34 is sized. The heel bulge 60 defines a U-shaped cavity 62 which opens upwardly at the interior surface 52.

Figure 7:
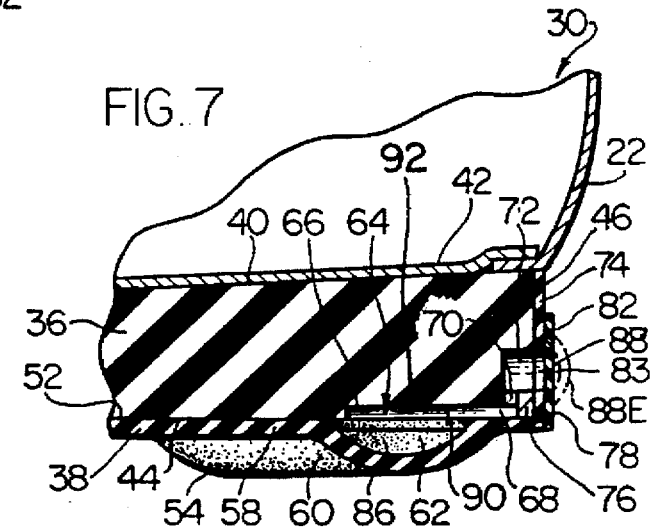
FIG. 7 is an enlarged, fragmentary, sectional view taken generally along the line 7—7 of FIG. 5.

A channel cavity 64, as seen in FIGS. 2, 4 and 7, is molded into the midsole 36 and opens downwardly at the downwardly facing surface 44. The channel cavity 64, as seen in FIG. 7, extends from a first end 66 which overlies and communicates with the U-shaped cavity 62 to a second end 68 which communicates with a bore 70 in the midsole 36 generally perpendicular to the downwardly facing surface 44, which in turn communicates with a cylindrical cavity 72 opening of the peripheral side surface 46.

The outsole 38 also includes, as seen in FIGS. 1, 3, 4, 6 and 7, an upstanding flange or blinker 74 adjacent the rear of the heel portion 58. The blinker 74 includes an interior surface 76 facing the rear end of the peripheral side surface 46 of the midsole 36 and an exterior surface 78 opposite the interior surface 76. The blinker 74 has an oval aperture 80 therethrough and an expansible rectangular membrane 82 which can be constructed of a fluid-impervious, elastic-type material, such as rubber. The membrane 82 overlies the oval aperture 80 and is attached to the exterior surface 78 by vulcanization or an appropriate adhesive. As seen in FIG. 3, the membrane 82 and the oval aperture 80 together define an expansible cavity 83.

As seen also in FIG. 3, the outsole 38 is usually first made as a flat-piece and has a fold line 84 which is thinner than the remainder of the outsole 38 to allow the blinker 74 to be folded upright to face the peripheral side surface 46 of the midsole 36.

An adhesive is disposed between the interior surface 52 of the outsole 38 and the downwardly-facing surface 44 of the midsole 36 and between the interior surface 76 of the blinker 74 and the peripheral side surface 46 of the midsole 36 for fixedly securing the midsole 36 and the outsole 38 together in a fluid-tight manner. In this regard, as discussed above, it will be appreciated that the midsole 36 and the outsole 38 are formed of fluid-impermeable materials and are also resilient to accommodate flexing during use of the shoe 30. Thus, the midsole 36 and the outsole 38 cooperate to hermetically seal the cavities 62 and 83 and form a heel pocket 86 and an expansible pocket 88, and to seal the cavities 64 and 72 and the bore 70 and form a restricted passageway 90, permanently trapping air or other fluid at atmospheric (or other) pressure in the pockets and passageway.

Heel pocket 86 is defined by the U-shaped cavity 62 and the portion of the midsole 36 overlying the cavity 62. Restricted passageway 90 is defined by channel cavity 64 and the portion of the midsole 36 overlying the channel cavity 64, the bore 70 and the cylindrical cavity 72. Expansible pocket 88 is defined by the expansible cavity 83 and the portion of the midsole 36 overlying the expansible cavity 83.

As best seen in FIG. 7, restricted passageway 90 has a first opening 92 by the first end 66 of the channel cavity 64 which opens downwardly into the heel pocket 86 and a second opening 94 at the peripheral side surface 46 which opens into the expansible pocket 88. The restricted passageway 90 thereby allows the heel pocket 86 to fluidly communicate with the expansible pocket 88.

The expansible pocket 88 has a minimum volume and a maximum volume after it has been fully expanded. The maximum volume of the expansible pocket 88 is less than the volume of the heel pocket 86.

In use, the air in pocket 86 provides a shock absorption or cushioning effect. In walking and running, the heel bulge 60 of the outsole 38 first comes in contact with the ground and causes the air to be compressed in the heel pocket 86 and forced through the passageway 90 into the expansible pocket 88, to cause the membrane 82 and the expansible pocket 88 to resiliently expand and be under a higher pressure, as seen by the dotted line 88E, in FIG. 7. As the heel portion lifts off the ground and the force is removed from the heel bulge 60 and the heel pocket 86, the pressure difference between heel pocket 86 and the expansible pocket 88 and the elastic nature of the membrane 82 cause the membrane to return to its flat, pre-expanded state. This forces the fluid from the higher pressure expansible pocket 88 through passageway 90 into the lower pressure heel pocket 86 to prepare the heel pocket 86 for again providing shock absorption when the heel bulge 60 again strikes the ground.

The resistance of the membrane 82 to expansion cooperates with the restrictions of the passageway 90 to impede the fluid in the heel pocket 86 from immediately rushing out of the heel pocket 86 when force is applied to the bulge 60. It is believed that, if there was no such resistance, the fluid would rush more rapidly out of heel pocket 86 and the heel bulge 60 would collapse and significantly reduced shock absorption would be provided to a wearer.

To accommodate the particular use of the shoe 30 and the weight of the wearer, the resistance of the membrane 82 to expansion can be varied by changing the thickness of the membrane 82 or the material that the membrane is constructed of. For example, only a moderate amount of pressure is applied to heel bulge 60 when the shoe 30 is used for walking. A greater amount of pressure is applied when the shoe is used for running. Therefore, a shoe designed for running would have a thicker membrane 82 or a membrane 82 more resistant to expansion than a shoe designed for walking. Similarly, a shoe designed for a 200 pound man would have a thicker membrane 82 or a membrane 82 more resistant to expansion than a membrane 82 of a shoe designed for a 100 pound woman.

As seen in FIG. 1, the exterior surface 54 of the sole portion 56 of the outsole 38 of the shoe 30 is relatively flat. This allows the shoe 30 to be versatile. Spikes for golf or baseball, for example, could be placed on this flat surface.

Figure 8:
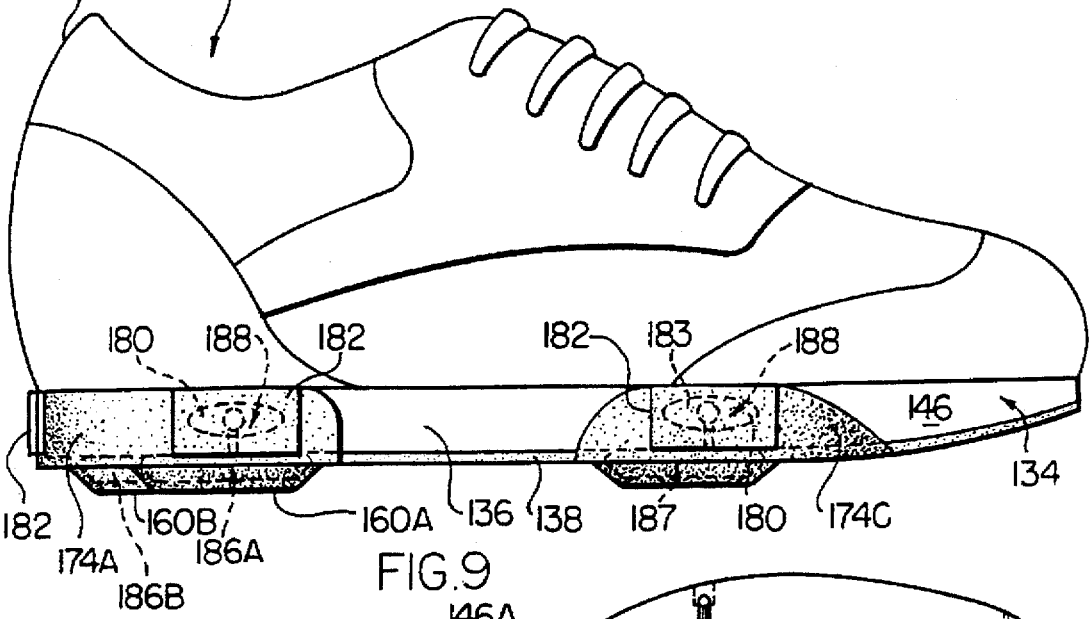
FIG. 8 is a view similar to FIG. 1, but from the opposite side, of a shoe incorporating a sole and heel structure in accordance with another embodiment of the present invention.
Figure 9:
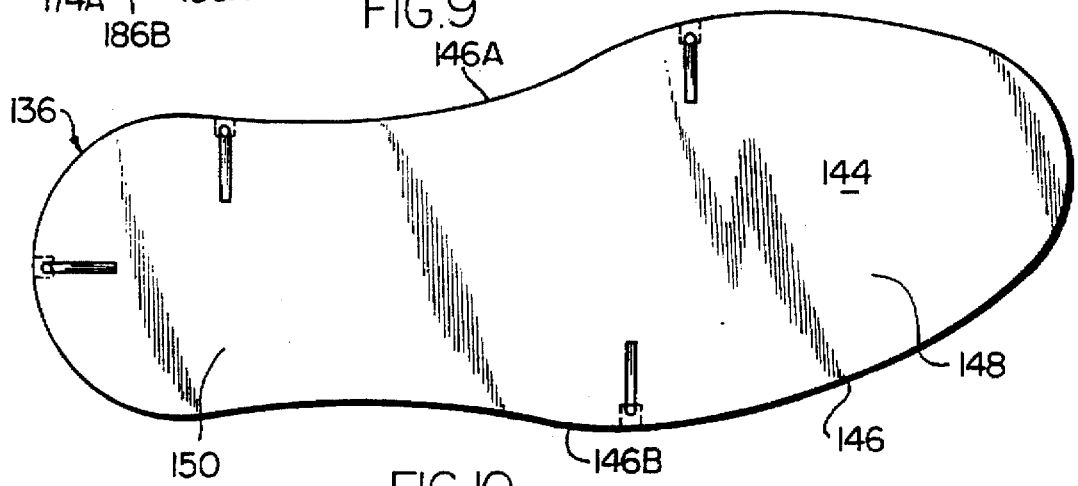
FIG. 9 is a bottom plan view of the midsole of the shoe of FIG. 8.
Figure 11:
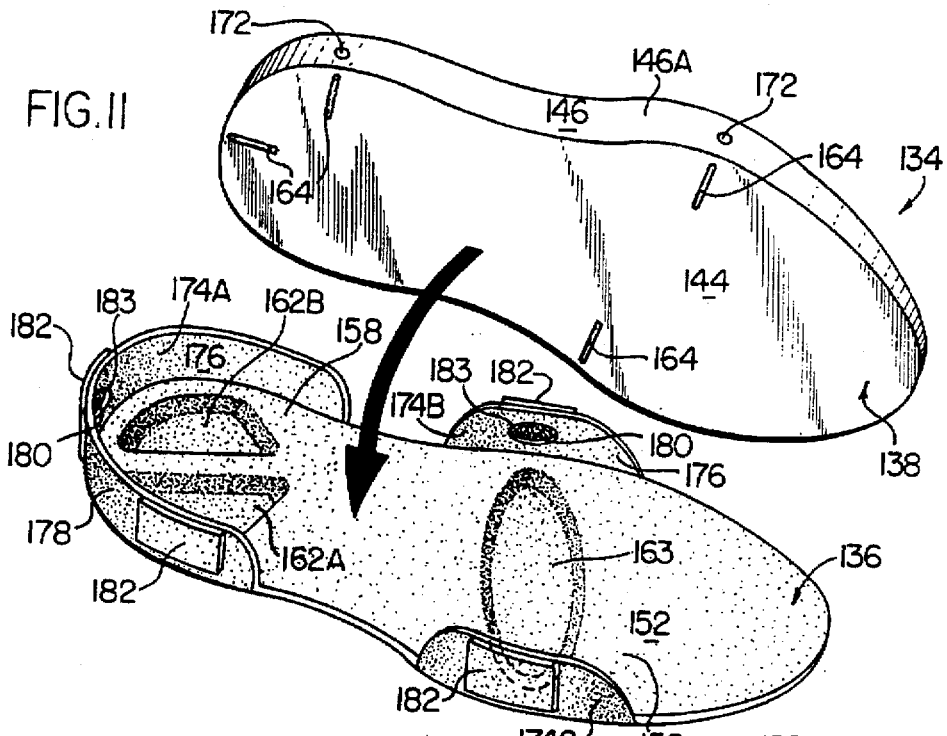
FIG. 11 is an exploded, perspective view of the outer sole and heel structure of the shoe of FIG. 8.
Figure 12:
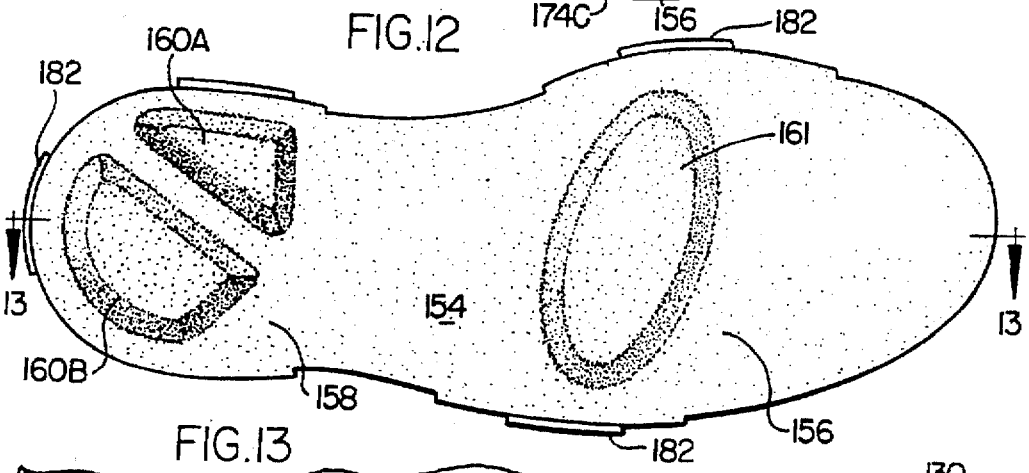
FIG. 12 is a bottom plan view of the shoe of FIG. 8.
Figure 13:
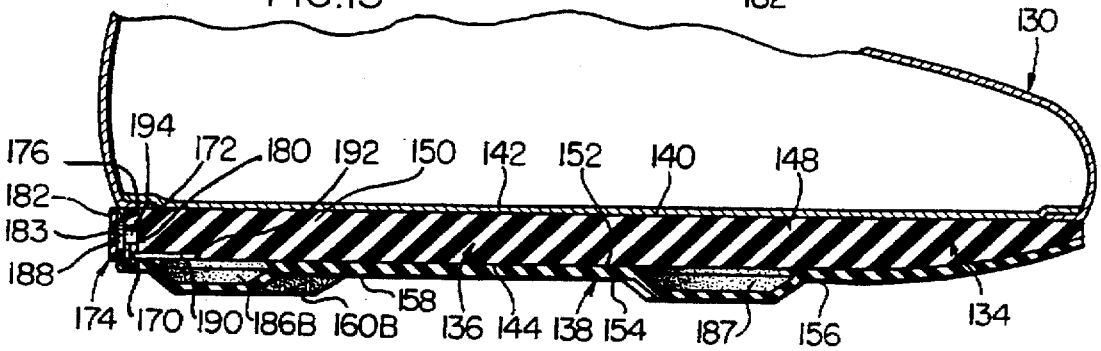
FIG. 13 is a fragmentary, sectional view taken generally along the line 13—13 of FIG. 12.

As seen in FIGS. 8–13, an alternate embodiment of the present invention having properly placed fluid-containing metatarsal and heel pockets is illustrated. Referring to FIG. 8, a shoe 130 having a conventional upper or last 132 is provided. The shoe 130 also includes an outer sole and heel structure 134. The structure 134 includes a midsole 136 overlying an outsole 138. The midsole 136 has an upwardly facing surface 140 which faces, as seen in FIG. 13, a sock-liner 142, and a downwardly facing surface 144 which faces the outsole 138. The midsole 136 also, as seen in FIGS. 8, 9, 11 and 13, has a peripheral side surface 146 disposed between the upwardly facing surface 140 and the downwardly facing surface 142. The peripheral side surface 146 has an inside edge surface 146A and an outside edge surface 146B. The midsole 136 may be made out of the same material as the midsole 36 of FIGS. 1–7. The midsole 136, as seen in FIGS. 9 and 13, has a sole portion 148 located under the sole of a wearer's foot and a heel portion 150 located under the heel of a wearer's foot.

As seen best in FIGS. 11–13, the outsole 138 has an interior surface 152 which faces the midsole 136 and an exterior surface 154 (opposite interior surface 152) which is subject to engagement with the ground. The outsole 138 also has a sole portion 156 located under the sole portion 148 of the midsole 136 and the sole of a wearer's foot and a heel portion 158 located under the heel portion 150 of the midsole 136 and the heel of a wearer's foot. The outsole 138 may be made of the same wear-resistant material as the outsole 38 of FIGS. 1–7.

Two flexible heel bulges 160A, 160B are molded into the heel portion 158 of the outsole 138 and project downwardly from the exterior surface 154 and underlie the heel area of a wearer's foot for which the sole and heel member 134 is sized. The heel bulges 160A, 160B define, respectively, heel cavities 162A, 162B which open upwardly at the interior surface 152. The heel bulge 160A is generally triangularly shaped and is positioned toward the laterally inner edge of the heel, while the heel bulge 160B is generally semicircular in shape and is positioned toward the laterally outer side of the heel. The heel bulge 160A projects forwardly of the heel bulge 160B. There is also molded in the outsole 138 and projecting from the exterior surface 154 a flexible metatarsal bulge 161 which extends generally laterally across the outsole 138 and underlies the metatarsal ball area of the foot of a wearer for which the shoe 130 is sized. The metatarsal bulge 161 defines a single, laterally elongated, metatarsal cavity 163 which opens upwardly at the interior surface 152.

The outsole 138 also includes, as seen in FIGS. 8 and 10–13, a heel flange or blinker 174A adjacent the rear of the heel portion 150 of the midsole 136, a lateral outer edge metatarsal flange or blinker 174B adjacent the outside edge 146B of the peripheral side surface 146 of the midsole 136, and a laterally inner edge metatarsal flange or blinker 174C adjacent the inside edge 146A of the peripheral side surface 146 of the midsole 136. Each blinker 174A–C includes an interior surface 176 facing the peripheral side surface 146 of the midsole 136 and an exterior surface 178 opposite the interior surface 176. Blinker 174A includes a pair of oval apertures 180 therethrough (FIGS. 8 and 13). Each of blinkers 174B and 174C also has an oval aperture 180 therethrough. Each oval aperture 180 also has an expansible, rectangular membrane 182 constructed of the same material as the membrane 82 of FIGS. 1–7 overlying it and attached to the respective exterior surfaces 178 of the blinkers 174A–C by vulcanization or an appropriate adhesive. The structure 134 also includes four expansible cavities 183. For brevity, only one cavity will be described in detail. As seen best with respect to the blinker 174B in FIG. 11, each membrane 182 together with an oval aperture 180 define an expansible cavity 183. Two expansible cavities 183 are formed on heel blinker 174A and one expansible cavity 183 is formed on each of the metatarsal blinkers 174B and 174C.

An adhesive is disposed between the interior surface 152 of the outsole 138 and the downwardly-facing surface 144 of the midsole 136 and between the interior surfaces 176A–C of the blinkers 174A–C and the peripheral side surface 146 of the midsole 136 for fixedly securing the midsole 136 and the outsole 138 together in a fluid-tight manner. Thus, the midsole 136 and the outsole 138 cooperate to hermetically seal and form heel pockets 186A, 186B, a metatarsal pocket 187, four expansible pockets 188, and four restricted passageways 190, permanently trapping air or other fluid at atmospheric (or other) pressure therein.

Figure 10:
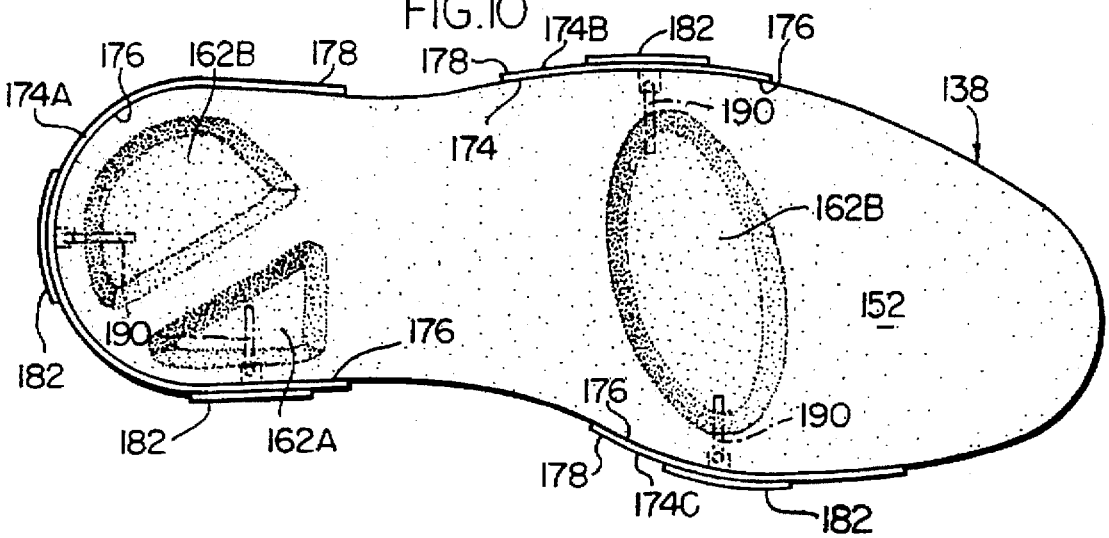
FIG. 10 is a top plan view of the outsole of the shoe of FIG. 8, where passageways are shown in phantom.

Heel pockets 186A, 186B and metatarsal pocket 187 are, respectively, defined by the cavities 162A, 162B and 163 and the portions of the midsole 136 overlying the cavities 162A, 162B and 163. For brevity, only one restricted passageway 190 and one expansible pocket 188 will be described in detail. Each restricted passageway 190 is substantially identical to passageway 90 of FIGS. 1–7. As seen best in FIG. 13, each restricted passageway 190 is defined by a channel cavity 164 and the portion of the midsole 136 overlying the channel cavity 152, a bore 170 and a cylindrical cavity 172 opening at the peripheral side surface 146. Each expansible pocket 188 is defined by an expansible cavity 183 and the portion of the midsole 136 overlying the expansible cavity 183. As seen in FIGS. 8, 10 and 13, heel pockets 186A, 186B are respectively connected to expansible pockets 188 by restricted passageways 190, metatarsal pocket 187 is connected to two expansible pockets 188 by two restricted passageways 190.

As best seen in FIG. 13, each restricted passageway 190 has a first opening 192 which opens downwardly into the respective heel or metatarsal pocket and a second opening 194 at the peripheral side surface 146 which opens into the respective expansible pocket 188. Each restricted passageway 190 thereby allows a pocket 186A, 186B, 187 to fluidly communicate with a corresponding expansible pocket or pockets 188.

Each expansible pocket 188 has a minimum volume and a maximum volume after it has been fully expanded. The maximum volume of each expansible pocket 188 is less than the volume of the pocket it is connected to.

In use, the air in pockets 186A, 186B, 187 provides a shock absorption or cushioning effect. In walking and running, the heel bulges 160A, 160B of the outsole 138 first come in contact with the ground and cause the air to be compressed in heel pockets 186A, 186B and forced through the respective, connected passageways 190 into the respective expansible pockets 188 to cause the expansible pockets 188 to expand and be under a higher pressure. As the heel portion 158 lifts off the ground and the force is removed from the heel bulges 160A, 160B and the heel pockets 186A, 186B, the pressure difference between heel pockets 186A, 186B and the respective, connected expansible pockets 188 and the elastic nature of the membranes 182 (which causes the membranes 182 to return to their flat, pre-expanded state) forces the fluid from the higher pressure in the expansible pockets 188 through respective passageways 190 into the respective lower pressure heel pockets 186A, 186B to prepare the heel pockets 186A, 186B for again providing shock absorption when the heel bulges 160A, 160B restrike the ground.

When the heel portion lifts off the ground, the metatarsal bulge 161 strikes the ground and causes the air in metatarsal pocket 187 to be compressed and forced through the passageways 190 connected to the expansible pockets 188 formed in blinkers 174B and 174C, which causes both of these expansible pockets 188 to expand and be under a higher pressure. When the sole portion 156 and the metatarsal bulge 161 lift off the ground, the membranes 182 forming part of these pockets 188 force the air back into the metatarsal pocket 187 to prepare the metatarsal pocket 187 for another strike with the ground.

Since the heel pockets 186A, 186B are not connected, no lateral or side-to-side air movement therebetween is possible, so as to prevent any tendency to promote lateral tilting of the shoe 130.

Figure 14:
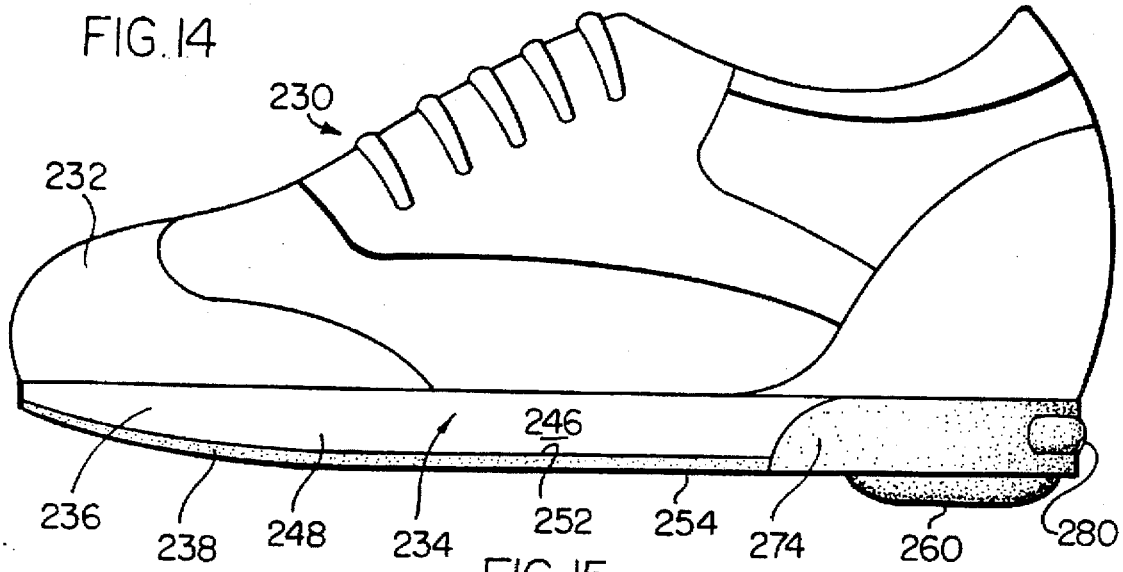
FIG. 14 is a view similar to FIG. 1 of a shoe incorporating a sole and heel structure in accordance with another embodiment of the present invention.
Figure 15:
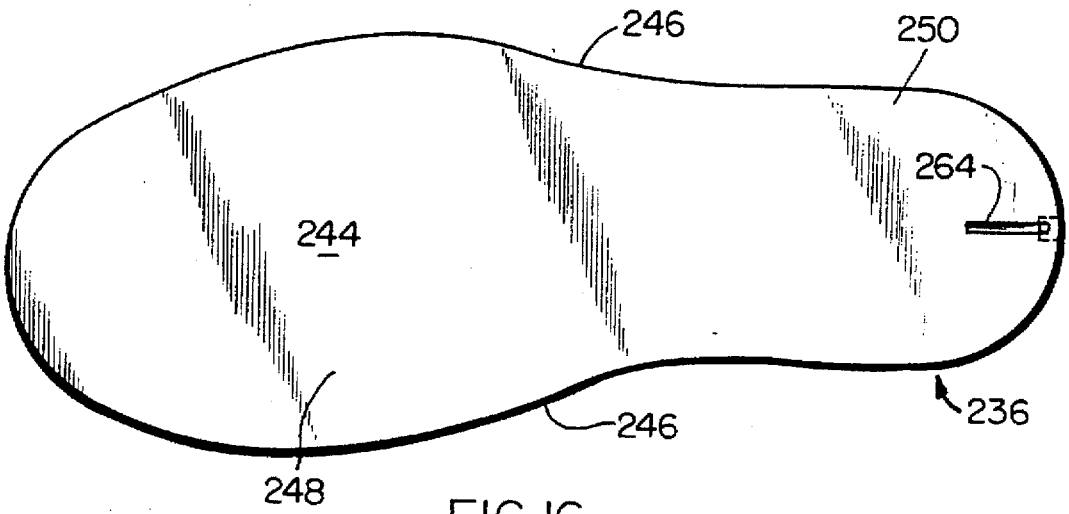
FIG. 15 is a bottom plan view of the midsole of the shoe of FIG. 14.
Figure 16:
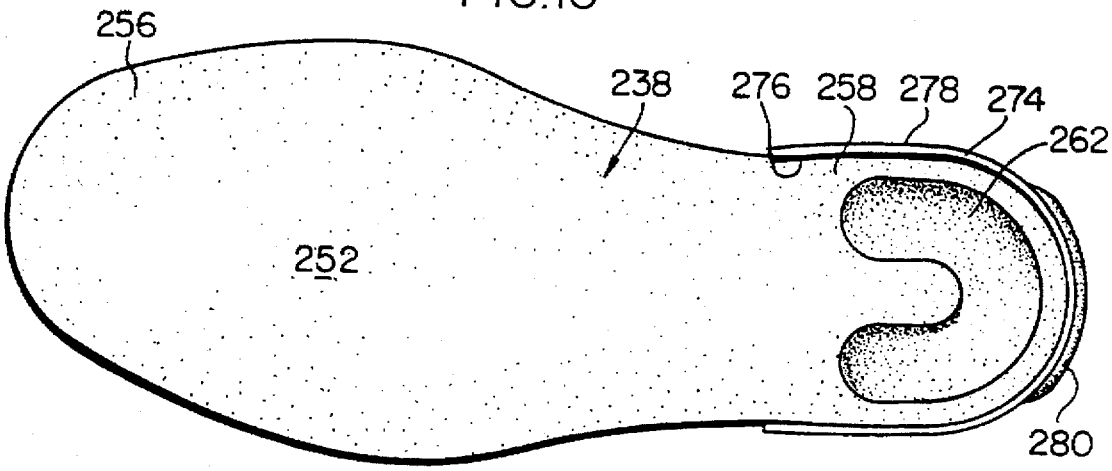
FIG. 16 is a top plan view of the outsole of the shoe of FIG. 14.
Figure 17:
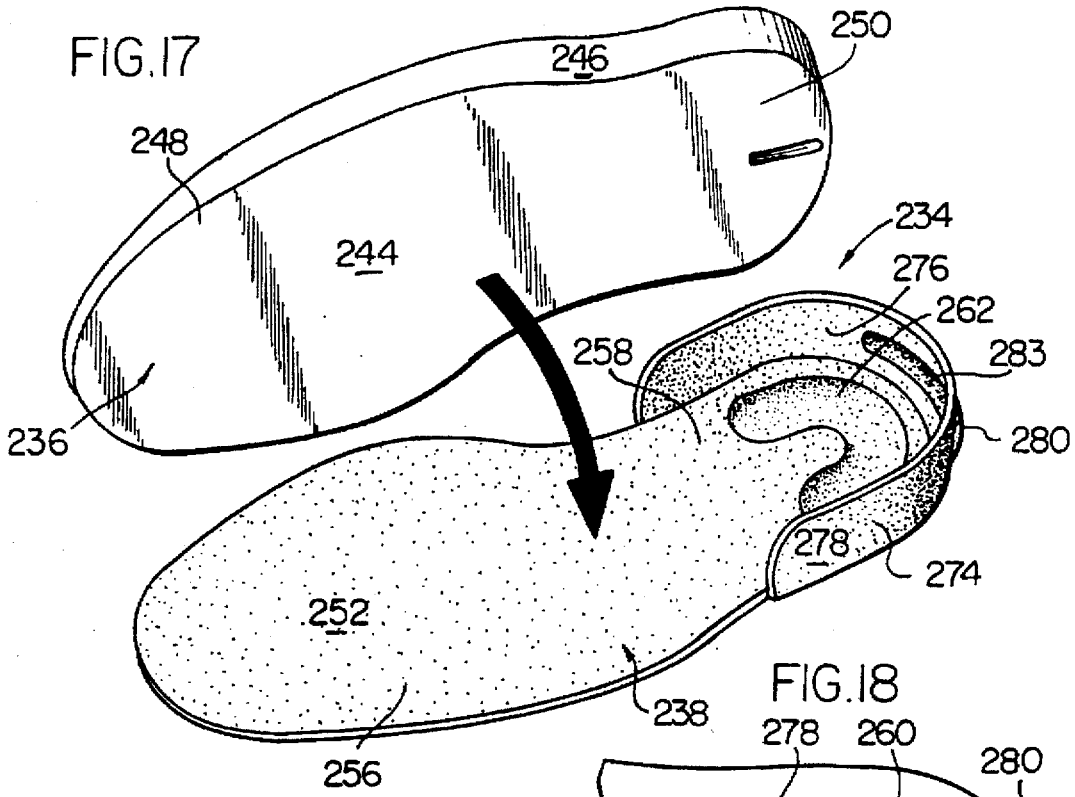
FIG. 17 is an exploded, perspective view of the outer sole and heel structure of the shoe of FIG. 14.
Figure 18:
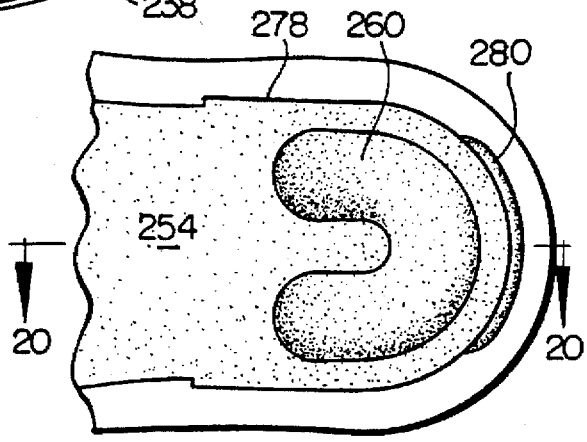
FIG. 18 is a fragmentary, bottom plan view of the shoe of FIG. 14.
Figure 19:
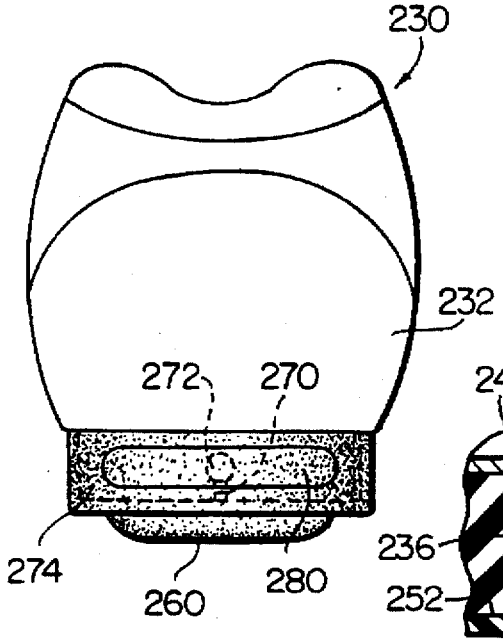
FIG. 19 is a rear elevational view of the shoe of FIG. 14.
Figure 20:
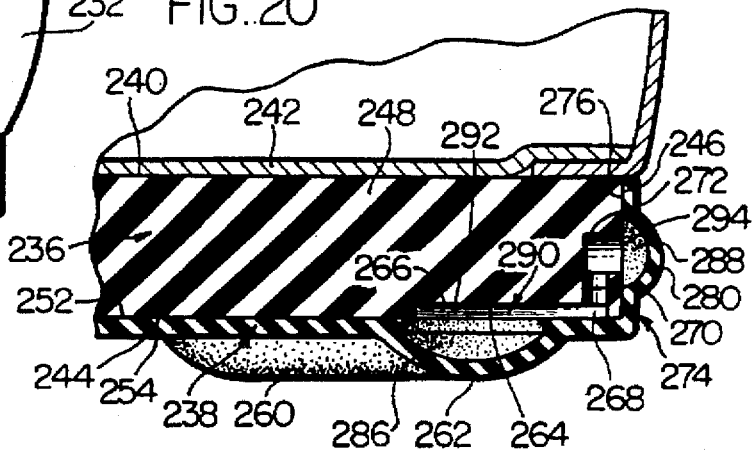
FIG. 20 is an enlarged, fragmentary, sectional view taken generally along the line 20—20 of FIG. 18.

As seen in FIGS. 14–20, a third embodiment of the present invention is illustrated. A shoe 230 having a conventional upper or last 232 is provided. The shoe 230 includes an outer sole and heel structure 234. The structure 234 includes a midsole 236 overlying an outsole 238. The midsole 236 has an upwardly facing surface 240 which faces, as seen in FIG. 20, a sock-liner 242, and a downwardly facing surface 244 which faces the outsole 238. The midsole 236 also, as seen in FIGS. 14, 15, 17 and 20, has a peripheral side surface 246 disposed between the upwardly facing surface 240 and the downwardly facing surface 244. The midsole 236 may be made out of the material as midsole 36 of FIGS. 1–7. The midsole 236, as seen in FIGS. 14, 15 and 17, has a sole portion 248 located under the sole of a wearer's foot and a heel portion 250 located under the heel of a wearer's foot.

As seen in FIGS. 14 and 16–20, the outsole 238 has an interior surface 252 which faces the midsole 236 and an exterior surface 254 opposite interior surface 252 which is subject to engagement with the ground. The outsole 238 also has a sole portion 256 located under the sole portion 248 of the midsole 236 and the sole of a wearer's foot and a heel portion 258 located under the heel portion 250 of the midsole 236 and the heel of a wearer's foot. The outsole 238 can be made of the same material as the outsole 38 of FIGS. 1–7.

A flexible, generally U-shaped heel bulge 260 is molded into the heel portion 248 of the outsole 238 and projects downwardly from the exterior surface 254. The heel bulge 260 underlies the heel area of a wearer's foot for which the sole and heel structure 234 is sized. The heel bulge 260 defines a U-shaped cavity 262 which opens upwardly at the interior surface 252.

A channel cavity 264 is molded into the midsole 236 and opens downwardly at the downwardly facing surface 244. The channel cavity 264, as seen in FIG. 20, extends from a first end 266 which overlies and communicates with the U-shaped cavity 262 to a second end 268 which communicates with a bore 270 in the midsole 236 generally perpendicular to the downwardly facing surface 244 which, in turn, communicates with a cylindrical cavity 272 opening of the peripheral side surface 246.

The outsole 238 also includes, as seen in FIGS. 14 and 16–20, a flange or blinker 274 adjacent the rear of the heel portion 250 of the midsole 236. The blinker 274 includes an interior surface 276 facing the peripheral side surface 246 of the midsole and an exterior surface 278 opposite the interior surface 276. The blinker 274 also includes an oval bulge 280 molded therein which projects outwardly from the exterior surface 278. The oval bulge 280 defines an oval cavity 283 (FIG. 17) which opens at the interior surface 276.

An adhesive is disposed between the interior surface 252 of the outsole 238 and the downwardly-facing surface 244 of the midsole 236 and between the interior surface 276 of the blinker 274 and the peripheral side surface 246 of the midsole 236 for fixedly securing the midsole 236 and the outsole 238 together in a fluid-tight manner. Thus, the midsole 236 and the outsole 238 cooperate to hermetically seal and form a heel pocket 286 and an expansible pocket 288, and a restricted passageway 290 permanently trapping air or other fluid at atmospheric (or other) pressure therein.

Heel pocket 286 is defined by the U-shaped cavity 262 and the portion of the midsole 236 overlying the cavity 262. Restricted passageway 290 is defined by channel cavity 264 and the portion of the midsole 236 overlying the channel cavity 252, the bore 270 and the cylindrical cavity 272. Expansible pocket 288 is defined by the oval cavity 283 and the portion of the peripheral side surface 246 of the midsole 236 overlying the oval cavity 283.

As best seen in FIG. 20, restricted passageway 290 has a first opening 292 by the first end 266 of the channel cavity 264 which opens downwardly into the heel pocket 286 and a second opening 294 at the peripheral side surface 246 which opens into the expansible pocket 288. The restricted passageway 290 thereby allows the heel pocket 286 to fluidly communicate with the expansible pocket 288.

The expansible pocket 288 has a minimum volume and a maximum volume after it has been fully expanded. The maximum volume of the expansible pocket 288 is less than the volume of the heel pocket 286.

In use, the air in pocket 286 provides a shock absorption or cushioning effect. In walking and running, the heel bulge 260 of the outsole 238 first comes in contact with the ground and causes the air to be compressed in the heel pocket 286 and forced through the passageway 290 into the expansible pocket 288 to cause the expansible pocket 288 to expand and be under a higher pressure. As the heel portion lifts off the ground and the force is removed from the heel bulge 260 and the heel pocket 286, the pressure difference between heel pocket 286 and the expansible pocket 288 and the elastic nature of the oval bulge 280 which naturally tries to return to its pre-expanded state, forces the fluid from the higher pressure in the expansible pocket 288 through passageway 290 into the lower pressure heel pocket 286 to prepare the heel pocket 286 for again providing shock absorption when the heel bulge 260 again strikes the ground.

Figure 21:
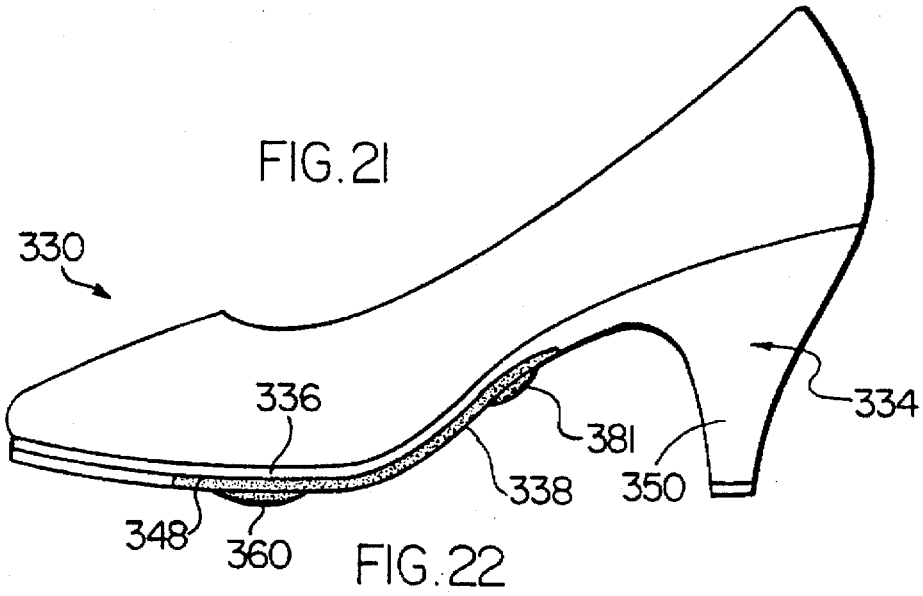
FIG. 21 is a side elevation view of a shoe incorporating another sole and heel structure in accordance with another embodiment of the present invention.
Figure 22:
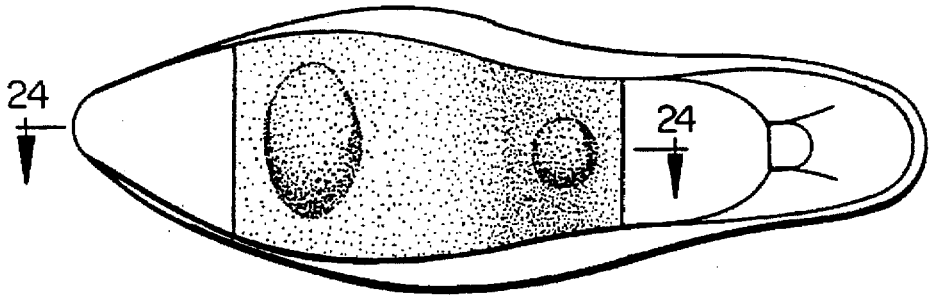
FIG. 22 is a bottom plan view of the shoe of FIG. 21.
Figure 23:
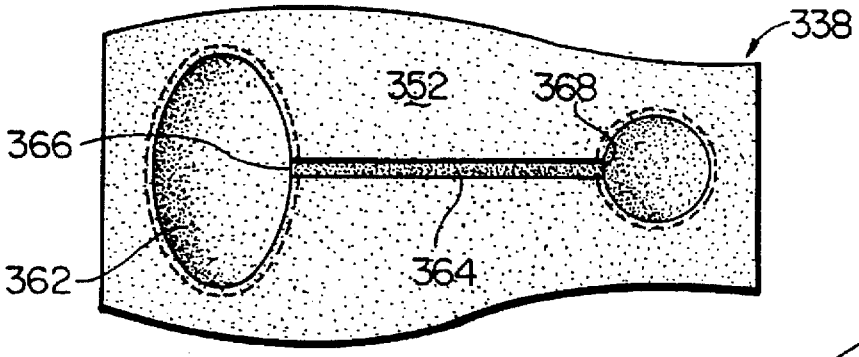
FIG. 23 is an enlarged, top plan view of a portion of an outsole member of the shoe of FIG. 21.
Figure 24:
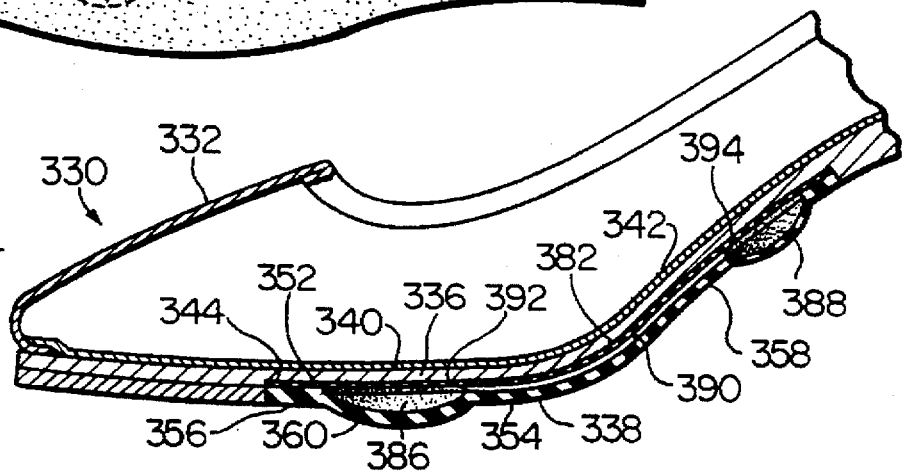
FIG. 24 is an enlarged, fragmentary, sectional view taken generally along the line 24—24 of FIG. 22.

As seen in FIGS. 21–24, a fourth embodiment of the present invention in the form of a woman's high heeled shoe 330 is provided. The shoe 330 includes an outer sole and heel structure 334. The structure 334 includes a midsole portion 336 overlying an outsole member 338. The outer sole and heel structure 334, as seen in FIG. 21 has a sole portion 348 located under the sole of a wearer's foot and a heel portion 350 located under the heel of a wearer's foot for which the structure 334 is sized. The midsole portion 336 has an upwardly facing surface 340 which faces, as seen in FIG. 24, a sock-liner 342, and a downwardly facing surface 344 which faces the outsole member 338. As discussed in greater detail below, the midsole portion 336 may be made out of almost any material, including leather or the same material of which the midsole 36 of FIGS. 1–7 is made.

As seen best in FIG. 24, the outsole member 338 has an interior surface 352 which faces the midsole portion 336 and an exterior surface 354 opposite interior surface 352. The outsole member 338 has a ground-contacting portion 356 in contact with the ground and a non-ground contacting portion 358 located above the ground. The outsole member 338 may be made of the same material as the outsole 38 of FIGS. 1–7.

A flexible, generally oval-shaped metatarsal bulge 360 is molded into the ground-contacting portion 356 of the outsole member 338 and projects downwardly from the exterior surface 354. The metatarsal bulge 360 underlies the metatarsal ball area of a wearer's foot for which the sole and heel structure 334 is sized. The metatarsal bulge 360, as seen in FIG. 23, defines an oval-shaped cavity 362 which opens upwardly at the interior surface 352.

A part-spherical bulge 381 is also molded into the non-ground contacting portion 358 of the outsole member 338 and projects outwardly from the exterior surface 354. The part-spherical bulge 381 defines a part-spherical expansible cavity 383 which opens inwardly at the interior surface 352. The thickness of the outsole member 338 is not constant along its length. The thickness of the outsole member 338 at the part-spherical bulge 381 is thinner than the thickness of the outsole member 338 at the oval-shaped metatarsal bulge 360. This allows the part-spherical bulge 381 to expand under fluid pressure.

As seen in FIG. 23, a channel cavity 364 is also molded into the outsole member 338 and opens upwardly at the interior surface 352. The channel cavity 364 extends from a first end 366 which communicates with the oval-shaped cavity 362 to a second end 368 which communicates with the part-spherical cavity 383.

As seen in FIG. 24, a sealing membrane 382 made of a fluid-impervious material covers and is adhesively attached to the interior surface 352 of the outsole member 338 in a fluid-tight manner. Thus, the membrane 382 and the outsole member 338 cooperate to hermetically seal and form a metatarsal pocket 386 and an expansible pocket 388, and a restricted passageway 390 permanently trapping air or other fluid at atmospheric (or other) pressure therein.

Metatarsal pocket 386 is defined by the oval-shaped cavity 362 and the portion of the membrane 382 overlying the cavity 362. Restricted passageway 390 is defined by channel cavity 364 and the portion of the membrane 382 overlying the channel cavity 364. Expansible pocket 388 is defined by the expansible part-spherical cavity 383 and the portion of the membrane 382 overlying the expansible cavity 383.

As best seen in FIG. 24, restricted passageway 390 has a first opening 392 by the first end 366 of the channel cavity 364 which opens into the metatarsal pocket 386 and a second opening 394 by the second end 368 of the channel cavity 364 which opens into the expansible pocket 388. The restricted passageway 390 thereby allows the metatarsal pocket 386 to fluidly communicate with the expansible pocket 388.

The membrane 382 is adhesively attached to the downwardly-facing surface of the midsole portion 336 to attach the outsole member 338 to the midsole portion 326.

The expansible pocket 388 has a minimum volume and a maximum volume after it has been fully expanded. The maximum volume of the expansible pocket 388 is less than the volume of the metatarsal pocket 386.

In use, the air in pocket 386 provides a shock absorption or cushioning effect. In walking and running, the metatarsal bulge 360 of the outsole member 338 comes in contact with the ground and causes the air to be compressed in the metatarsal pocket 386 and forced through the passageway 390 into the expansible pocket 388 to cause the expansible pocket 388 to expand and be under a high pressure. As the ground-contacting portion 356 of the outsole member 338 lifts off the ground and the force is removed from the metatarsal bulge 360, the pressure difference between expansible pocket 388 and metatarsal pocket 386 and the part-spherical bulge 381 trying to return to its pre-expanded state forces the fluid from the higher pressure expansible pocket 386 through passageway 390 back into the lower pressure metatarsal pocket 386 to again provide shock absorption when the metatarsal bulge 360 again strikes the ground.

If the outsole member 338 is damaged or wears down, it and the sealing membrane 382 can be advantageously removed and replaced without the need to replace other portions of the shoe 330.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A shoe sole and heel construction for use with a shoe upper, the construction comprising:

a structure having a foot facing surface, an exterior ground-contacting surface and an exterior non-ground contacting surface disposed between the ground-contacting surface and the foot facing surface to avoid contact with the ground in use, a flexible bulge formed in the structure and projecting from the exterior ground-contacting surface for contact with the ground in use and defining a first pocket, a second resiliently expansible pocket formed at least in part by an elastic material disposed at the exterior non-ground contacting surface and formed in the structure and disposed away from the ground-contacting surface, a passageway formed in the structure and communicating with each of the first and second pockets, and fluid permanently confined in a space jointly defined by the pockets and the passageway, whereby when an external force is applied to the bulge, fluid is forced from the first pocket through the passageway to expand the second pocket and when the external force is removed, the expanded second pocket resiliently forces fluid back to the first pocket.

2. The construction of claim 1, wherein the structure includes a heel portion and a sole portion and the first pocket is disposed in the sole portion and underlies the metatarsal ball area of a foot for which the structure is sized.

3. The construction of claim 1, wherein the structure includes a heel portion and a sole portion and the first pocket is disposed in the heel portion and underlies the heel area of a foot for which the structure is sized.

4. The structure of claim 1, wherein the second expansible pocket is defined by a non-ground contacting bulge projecting from the exterior non-ground contacting surface.

5. The structure of claim 4, wherein the exterior ground-contacting surface is contiguous with the exterior non-ground contacting surface.

6. A sole and heel structure comprising:

an outsole having first interior and exterior surfaces and a bulge projecting from the first exterior surface, the bulge defining a first cavity opening at the first interior surface;

a midsole overlying the outsole, the midsole having an outsole-facing surface, a foot-facing surface opposite the outsole-facing surface and a peripheral side surface disposed between the outsole-facing surface and the foot-facing surface;

a blinker adjacent the peripheral side-surface of the midsole, the blinker having a second interior surface and a second exterior surface and forming a second cavity opening at the second interior surface, means for hermetically attaching the first interior surface of the outsole to the outsole-facing surface of the midsole to form a member having a sole portion and a heel portion, wherein the first cavity cooperates with a portion of the midsole to define a first pocket;

means for hermetically attaching the second interior surface of the blinker to the peripheral side surface of the midsole, wherein the second cavity cooperates with a portion of the midsole to define a second pocket;

a passageway in the member providing fluid communication between the first and second pockets; and fluid permanently disposed in the space jointly defined by the first and second pockets and the passageway, wherein when force is applied to the first pocket, fluid moves from the first pocket through the passageway to cause the second pocket to be pressurized and when force is removed from the first pocket, at least a portion of the fluid moves back into the first pocket, whereby the first pocket provides shock absorption to a foot in a shoe incorporating the structure.

7. The structure of claim 6, wherein the passageway has a first opening at the outsole-facing surface of the midsole and a second opening at the peripheral side surface of the midsole.

8. The structure of claim 7, wherein the blinker includes a bulge projecting from the exterior surface of the blinker and defining the second cavity.

9. The structure of claim 7, wherein the blinker includes an aperture and an elastic membrane hermetically attached to the second exterior surface of the blinker and overlying the aperture, the aperture and the elastic membrane defining the second cavity.

10. The structure of claim 9, wherein the second pocket is expansible.

11. The structure of claim 7, wherein the blinker is integral with the outsole.

12. The structure of claim 7, wherein the first pocket is disposed in the heel portion under the heel of a foot for which the structure is sized.

13. The structure of claim 7, wherein the first pocket is disposed in the sole portion under the metatarsal ball area of a foot for which the structure is sized.

14. A sole and heel structure comprising:

an outsole having interior and exterior surfaces and a plurality of bulges projecting from the exterior surface, each bulge defining a first cavity opening at the interior surface;

a midsole overlying the outsole, the midsole having an outsole-facing surface, and a foot-facing surface opposite the outsole-facing surface and a peripheral side surface disposed between the outsole-facing surface and the foot-facing surface;

a plurality of blinkers adjacent the peripheral side surface of the midsole, each blinker having an interior surface, an exterior surface and a second cavity opening at the interior surface;

means for hermetically attaching the interior surface of the outsole to the outsole-facing surface of the midsole to form a member having a sole portion and a heel portion, wherein the first cavity cooperates with a portion of the midsole to define a first pocket;

means for hermetically attaching the interior surface of each blinker to the peripheral side surface of the midsole, wherein each second cavity cooperates with a portion of the midsole to define a second pocket;

a plurality of passageways in the member, each passageway providing fluid communication between one of the first pockets and one of the second pockets; and fluid permanently disposed in the space jointly defined by the first and second pockets and the passageways, wherein when force is applied to one of the first pockets, fluid moves from the first pocket through the passageway in communication therewith to cause the respective second pocket in communication with the passageway to be pressurized, and when force is removed from the first pocket, at least a portion of the fluid moves back into the respective first pocket, whereby each first pocket provides shock absorption to a foot in a shoe incorporating the structure.

15. The structure of claim 14, wherein at least one of the first pockets is disposed in the sole portion and underlies the metatarsal ball area of a foot for which the structure is sized.

16. The structure of claim 15, wherein the peripheral side surface has an inside edge surface and an outside edge surface, and the first pocket underlying the metatarsal ball area is disposed between the inside edge surface and the outside edge surface and in fluid communication with one of the second pockets defined by one of the second cavities at the inside edge surface of the peripheral side surface of the midsole and with another of the second pockets defined by a second cavity at the outside edge surface of the peripheral side surface of the midsole.

17. The structure of claim 15, wherein at least one of the first pockets is disposed in the heel portion and underlies the heel area of a foot for which the structure is sized.

18. The structure of claim 15, wherein at least two of the first pockets are disposed in the heel portion and underlie the heel area of a foot for which the structure is sized.

19. The structure of claim 14, wherein at least one of the first pockets is disposed in the heel portion and underlies the heel area of a foot for which the structure is sized.

20. The structure of claim 14, wherein at least two of the first pockets are disposed in the heel portion and underlie the heel area of a foot for which the structure is sized.

* * * * *